United States Patent [19]

Watanabe

[11] 4,050,183

[45] Sept. 27, 1977

[54] COIN TOY

[75] Inventor: Ietatsu Watanabe, Tokyo, Japan

[73] Assignee: Tomy Kogyo Co., Inc., Tokyo, Japan

[21] Appl. No.: 644,441

[22] Filed: Dec. 29, 1975

[30] Foreign Application Priority Data

Jan. 25, 1975 Japan ..... 50-10835

[51] Int. Cl.[2] ..... A63H 33/00

[52] U.S. Cl. ..... 46/4; 46/141; 46/145

[58] Field of Search ..... 46/4, 5, 129, 128, 148, 46/145, 141

[56] References Cited

U.S. PATENT DOCUMENTS

| | | | |
|---|---|---|---|
| 226,831 | 4/1880 | Bowen | 46/141 X |
| 255,090 | 3/1882 | Shepard et al. | 46/4 |
| 262,361 | 8/1882 | Bowen | 46/4 |
| 753,335 | 3/1904 | Ward | 46/145 |
| 1,568,711 | 1/1926 | Berger | 46/4 |
| 2,885,824 | 5/1959 | Lemelson | 46/129 X |

*Primary Examiner*—F. Barry Shay
*Attorney, Agent, or Firm*—Staas & Halsey

[57] ABSTRACT

A coin toy is disclosed wherein a replica of a large mouth and a tongue are mechanically actuated to receive a coin tossed by a coin holding lever, which is manually set. The mechanism provides for a suction cup attached to a coin holding lever, both of which are mounted on a spring loaded actuation plate. When the coin holding lever is manually depressed and set, the suction cup holds to a fixed attraction plate until spring loading forces overcome the suction forces and cause the coin holding arm and the actuation plate to rapidly return to their upward positions. The rapid returning of the plate and the coin holding lever causes the mouth to open, and the tongue to extend therefrom to receive a coin which is thrown from the coin holding lever.

5 Claims, 4 Drawing Figures

COIN TOY

BACKGROUND OF THE INVENTION

1. Field of the Invention

This invention relates to a coin toy. More particularly, the invention relates to a toy which provides kinetic motion to a coin being deposited in a uniquely characteristic bank.

2. Description of the Prior Art

In the prior art, many coin toys have been developed which kinetically move a deposited coin from a first position to a second position. Generally, the second position is a storage box which serves as a savings bank. In the prior art, the kinetic action is generally derived from a power source such as an electric motor driven by a battery source, a mechanical motor driven by a wind-up spring mechanism or a gravity system.

SUMMARY OF THE INVENTION

The present invention of a coin toy involves a sophisticated mechanism which is actuated by a single downward movement of a coin-holding lever. Upon release of the coin-holding lever, the mechanism of the coin toy causes a coin placed upon the coin holding lever to be thrown towards a replica of a relatively large mouth, which is opened to receive the coin and closed immediately thereafter.

It is an object of the present invention to provide a coin toy which comprises a coin-throwing actuation plate having a coin-holding lever at the upper end thereof. The coin-throwing actuation plate is vertically supported by a machine frame for rotation in an generally vertical direction. The coin-holding lever of the actuation plate includes a suction cup which is capable of holding to an attracting plate disposed below the lever. A spring is provided with one end attached to the actuation plate and the other end attached to the machine frame. The spring acts to overcome the suction forces, when the suction cup is held to the attracting plate, and rotate the actuation plate upwardly. A replica of a relatively large mouth capable of opening and closing in a vertical direction is provided above the coin throwing actuation plate so that when the actuation plate is rotated upwardly, the mouth is opened by the upward rotation. The coin toy is constructed so that when the suction forces are overcome by the spring, the coin-throwing actuation plate including the coin-holding lever, is rapidly rotated in an upward direction and the mouth is opened. A coin placed on the coin-holding lever is thrown into the open mouth.

It is also an object of the present invention to provide a coin toy which further comprises a rotary plate having a tongue piece attached to the upper end portion thereof. The rotary plate is vertically supported by the machine frame for rotation in a generally horizontal direction. A pull spring is attached to bias the upper end portion of the rotary plate in a normally retreated position. A mechanism is disposed to rotate the rotary plate in the forward direction when said coin throwing actuation plate with the arm portion is rapidly swung in an upward direction. The mouth is interlocked with the forward rotation of said rotary plate and is thus opened by said forward rotation. The tongue piece placed in the interior of the mouth is moved forward upon the opening of the mouth so that the top end of the tongue piece projects slightly from the open mouth and a coin thrown into the open mouth can be received on the tongue piece. When the tongue piece is retreated by the action of the pull spring the mouth is closed.

It is a further object of the present invention to provide a coin toy which is both fanciful an sophisticated in its operation and does not require the use of electricity or a wind-up spring mechanism. Furthermore, the coin toy of the present invention also serves as a unique savings bank.

DETAILED DESCRIPTION OF THE INVENTION

Figure 1:
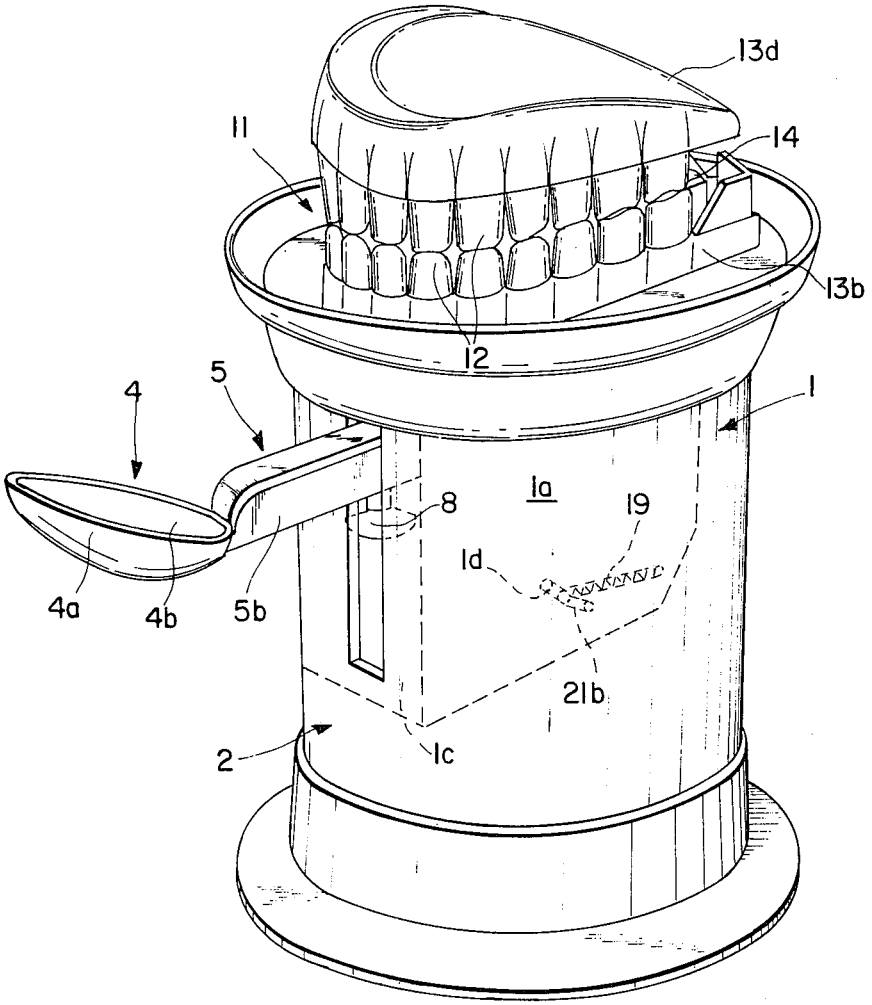
FIG. 1 is a perspective view of an embodiment of the present invention.
Figure 4:
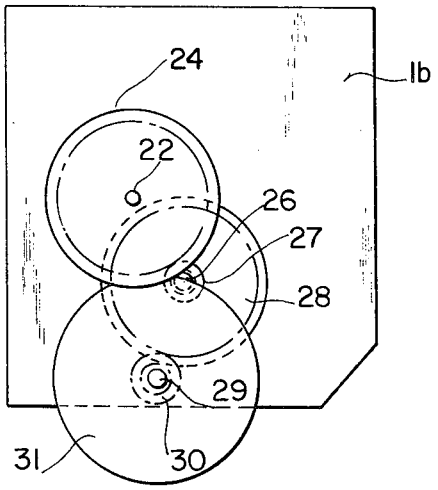
FIG. 4 is an enlarged side view showing the gear arrangement.
Figure 3:
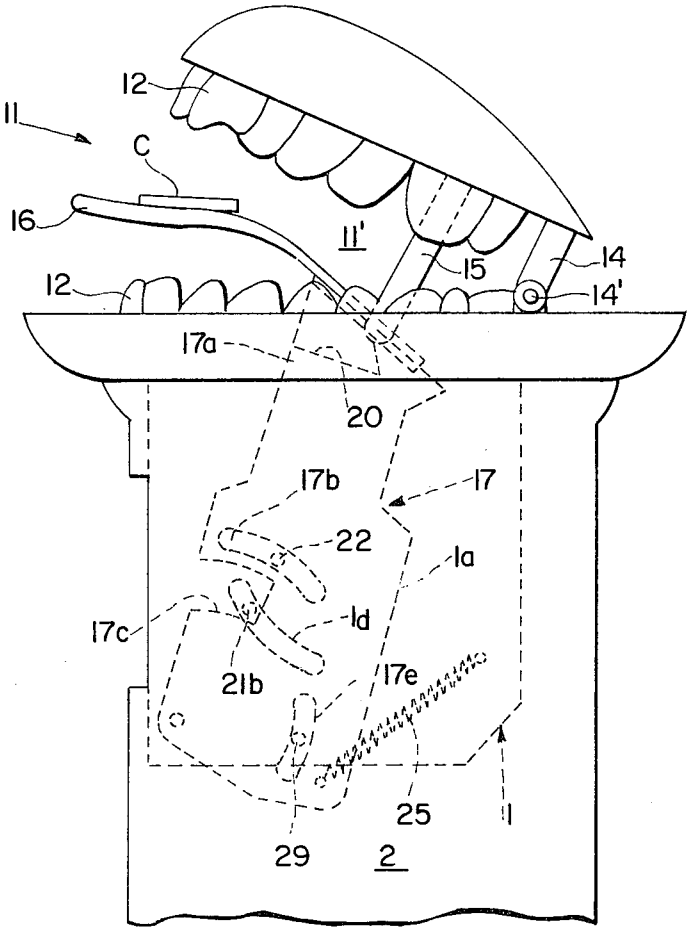
FIG. 3 is a partially cut-out, enlarged side view showing the mouth-opened state, where the coin-throwing actuation plate and other members are not illustrated.

The various elements shown in the drawings are defined as follows:

1, machine frame; 2, casing; 4, coin-setting part; 5, coin-holding lever; 6, coin-throwing actuation plate; 8, suction cup; 9, attracting plate; 10, spring; 11, mouth; 12, teeth; 15, engaging projections; 16, tongue piece; 17, rotary plate; 19, pull spring; 21, cam plate; 31, fly wheel.

This invention will how be described by simultaneous reference to FIGS. 1 through 4.

The drawings illustrate an embodiment of the present invention, and referential numeral 1 denotes a machine frame, the upper end of which is fixed to an inner upper wall 3 of a casing 2. A coin-throwing actuating plate 6 is shown, which has a coin-holding lever 5 with a coin-setting part 4 disposed at the top end thereof. The plate 6 is vertically supported between both left and right side walls 1*a* and 1*b* of the machine frame 1 through a horizontal fulcrum shaft 7 so that the plate 6 can be rotated in a generally vertical direction about the horizontal shaft 7. The plate 6 has a substantially right-angled triangle form, with the side 6*d* approximating a hypotenuse of the right-angled triangle facng the front of the machine frame 1 and the apex or right angled portion being supported by the fulcrum shaft 7. An arc-like notch 6*a* is formed in the intermediate portion of the side 6*d* and the lever 5 is disposed close to the upper end thereof. The lever 5 may be integrally formed, but it is generally preferred that the lever 5 be divided into a base 5*a* and an extension 5*b* with the extension 5*b* being dismountably attached to the base 5*a*.

The coin-setting part 4, mounted at the top end of the lever 5 has an expanded form resembling the top portion of a spoon, and two circular recesses 4*a* and 4*b* differing in the diameter are formed on the top face of the part 4 so that coins differing in diameter can be received thereon. The circular recess 4*b* of a smaller diameter is located at a position closer to the lever 5.

The lever 5 is projected through an opening 1*c*′ through a front wall 1*c* of the machine frame 1 and an opening 2*a*′ formed on the front portion of the casing 2 facing the front wall 1*c* of the machine frame 1. A suction cup 8, formed of a rubber or soft synthetic resin is fixed to the underside of the lever 5. This suction cup 8 is so disposed, that when the lever 5 is downwardly actuated and the plate 6 is thereby rotated about fulcrum shaft 7, the suction cup 8 holds by a suction force to an attracting plate 9, which is forwardly inclined and disposed on the inside of the opening 1c' of the machine frame 1. One end of a spring 10, having an elastic force capable of overcoming the suction force of the suction cup 8 to the attracting plate 9, is connected to the plate 6 at a point 35 near the lower corner thereof, and the other end of the spring 10 is fixed to the machine frame 1 at a point 36. Because of the disposition of the spring 10, the lever 5 is normally deviated upwardly, and when the lever 5 is pushed down the suction cup 8 is held to the attracting plate 9 by a suction force. The elastic force of the spring 10 overcomes the suction force of the suction cup 8 to separate the suction cup 8 from the attracting plate 9, thereby causing the lever 5 to be swung upwardly.

A replica of a relatively large mouth 11, facing the same direction as the lever 5, is disposed at the upper end portion of the machine frame 1 so that the upper part of the mouth 11 can be opened and closed in the vertical direction. The mouth 11, as a whole, is molded to have a form resembling the mouth portion of a human or animal skeleton. However, it is recognized that this is a preferred embodiment, and that replicas of any opening and closing devices could be equivalently adapted. In the embodiment shown in the drawings, the mouth 11 is provided with upper and lower jaws 13a and 13b having teeth 12. The lower jaw 13b is fixed to the upper wall 3 of the casing 2, and the upper jaw 13a is pivoted on a bracket 14, disposed at the rear end portion of the lower jaw 13b, on a shaft 14' so that it can turn on a horizontal axis coincident with the shaft 14'. In the normal state, the mouth 11 is closed. An engaging projection 15 is disposed at a suitable part of the rear portion of the upper jaw 13a to hang down therefrom. This engaging projection 15 is utilized as an actuation lever by which the upper jaw 13a is pivoted and the mouth 11 opened or closed. Projection 15 is shown contacting step 20 on a rotary plate 17 but in the alternate, may be directly or indirectly interlocked with the plate 6. In either case, the projection 15 is moved upwardly when the actuation plate 6 is swun upwardly by the release of the suction cup 8 or shortly thereafter by the forward movement of the plate 17. By the upward movement of the engaging projection 15, the upper jaw 13a is pushed upwardly and is rotated. The shaft 14' acts aa a fulcrum for opening the mouth 11. Alternative embodiments are described below for causing said upper jaw 13a to move upwardly.

When the lever 5 is pushed down, with a hand, against the elastic force of the spring 10, the suction cup 8 holds by a suction force to the attracting plate 9, and by this suction force the lever 5 is tentatively held in a declined position. A coin C is placed on the recess 4a or 4b of the coin-setting part 4. Then, the hand is released from the lever 5, and the restoring force of the spring 10 overcomes the suction force of the suction cup 8 so that the suction force of the suction cup 8 is gradually lost and finally becomes completely ineffective. At the moment when the suction cup 8 completely loses its suction force, the spring 10 swings the lever 5 rapidly upward and the actuating plate 6 is simultaneously rotated rapidly upward causing the mouth 11 to be opened. The coin C on the coin-setting part 4 is thrown into the opened mouth 11, by the swinging movement of the lever 5. In this case, since the coin-setting part 4 travels through a rotation locus having a radius corresponding to the distance to the fulcrum shaft 7, the locus drawn by the thrown coin C is substantially along the extension of the rotation locus of the coin-setting part 4. Accordingly, the length of the lever 5 is adjusted so that the extension of the rotation locus of the coin-setting part 4 passes through the interior of the opened mouth 11 when the elastic force of the spring 10 overcomes the suction force of the suction cup 8, causing the coin C to be thrown into the opened mouth 11.

A rotary plate 17 having a tongue piece 16 attached to the upper end portion thereof is shown. In this embodiment, the tongue piece 16 is molded to resemble the tongue of a man or animal. The plate 17 is vertically mounted to pivot between respective left and right side walls (1a and 1b) of the machine frame 1 at a fulcrum shaft 18, so that the plate 17 can be rotated forward about a horizontal axis defined by shaft 18. This plate 17 is substantially rectangular in form and is supported by the shaft 18 at the lower front corner thereof. The upper end portion 17a of the plate 17 is partially projected into a cavity 11', through a long slot 3a formed in the upper wall 3 of the casing 2 so that it can slide along the slot 3a and extend in the forward direction. The plate 17 is pulled rearward to resume the normal state by means of a pull spring 19 having one end connected to the machine frame 1 at point 37. The tongue piece 16 attached to the upper end portion 17a of plate 17 is positioned in the cavity 11' upwardly and obliquely during the normal state. However, when the rotary plate 17 is rotated forward, the tongue piece 16 also moves forward and is substantially horizontal.

An engaging step 20 is shown engaged with the lower end portion of the engaging projection 15, and is formed at the upper end portion 17a of the plate 17. When the plate 17 is rotated forward, the step 20 pushes the lower end of the engaging projection 15 forward, causing the upper jaw 13a to pivot upward, and thereby opening the mouth 11. The mouth 11 remains open until the plate 17 returns to its normal position. In an alternative embodiment, as described previously, a member corresponding to the engaging step 20 may be mounted on the front upper end portion of the plate 6 so that it can be engaged with the engaging projection 15. In another alternative embodiment, a push-up projection (not shown) may be mounted at a suitable part of the plate 6 to push up the upper jaw 13a. In still another alternative embodiment, the upper jaw 13a may be interlocked with the plate 6 through a lever mechanism (not shown).

A cam plate 21 having a notched disk-like form is disposed between the plate 6 and the plate 17. This cam plate 21 is fixed to a rotary shaft 22 rotatably supported between both left and right side walls 1a and 1b of the machine frame 1. The shaft 22 extends through a curved slot 17b provided at the central portion of plate 17 and also through the notch 6a in plate 6. The cam plate 21 is provided with a lateral projection 21a, for engaging with a projection 6b formed at a suitable part of the upper portion of the plate 6. A pin 21b extends outwardly from the plate 21 through an arc-like notch 17c formed at a suitable part of the front portion of the plate 17 and an arc-like slot 1d provided on the left side wall 1a of the machine frame 1. Ratchet teeth 21d extend from the forward portion of the plate 21 for engaging with a nail 23' pointing downwardly from the end of a nail arm 23 extending rearwardly along the left side wall 1a from the inside upper portion of the front wall 1c of the machine frame 1. On that portion of the pin 21b of the cam plate 21 which extends outwardly through said arc-like slot 1*d*, one end of the pull spring 19 is connected so that the upper end portion 17*a* of the rotary plate 17 is biased rearward, and the other end of the spring 19 is fixed to a pin 37 at the rear portion of the machine frame 1. During normal conditions, the cam plate 21 is rotated to a position wherein the ratchet teeth 21*d* do not engage the nail 23' and a lateral projection 32 from the plate 6 bears against the underside of said nail arm 23 thereby allowing said ratchet teeth 21*d* to engage said nail 23' only when the plate 6 is rotated downward.

One end of another pull spring 25 is connected to the rear portion of the machine frame 1, at 39 and the other end of the pull spring 25 is connected to the rear lower end portion 40 of the plate 17. As described hereinafter, when the action of the pull spring 19 is stopped, the pull spring 25 is actuated to rotate the plate 17 forward. A lateral projection 17*d* is provided at a suitable part of the rear intermediate portion of the plate 17 so that the projection 17*d* is engated with a lateral cylindrical projection 6*c* provided on the plate 6, in the vicinity of the lower end of the arc-like notch 6*a*.

A gear 24 is fixed to the rotary shaft 22 of the cam plate 21 at a position approximating the right side wall 1*b* of the machine frame 1, and this gear 24 is engaged with a pinion 27 freely fitted to a shaft 26 fixed to the right side wall 1*b* below said gear 24. A gear 28 is integrated coaxially with the pinion 27, and the gear 28 is engaged with a pinion 30 rotating on a shaft 29, which penetrates through an arc-like slot 17*e* on the lower intermediate portion of the plate 17 and is rotatably supported below said gear 28 between both left and right side walls 1*a* and 1*b* of the machine frame 1. A fly wheel 31 having a function mentioned below is fixed to the rotary shaft 29.

The coin toy of the present invention is actuated in the following manner.

The coin-holding lever 5 is pushed down against the elastic force of the spring 10, causing the coin-throwing actuation plate 6 to be rotated downwardly with the fulcrum shaft 7 providing a fulcrum. At this moment, the lateral projection 6*b* of the actuation plate 6 is engaged with the projection 21*a* of the cam plate 21 and the cam plate 21 is rotated clockwise, whereby the ratchet teeth 24 of the cam plate 21 is moved toward the nail 23' of the nail arm 23 to engage therewith. The lever 5 is pushed down until the suction cup 8 is held by suction forces to the attracting plate 9 and the ratchet teeth 24 become engaged with the nail 23'. The cam plate 21 is thus rotated clockwise, by the lateral projection 6*b*, in a direction opposite to the acting direction of the pull spring 19. Accordingly, the pull spring 19 is extended to store energy therein. The pull spring 19 is connected to normally bias the upper end portion 17*a* of the rotary plate 17 rearward by the engagement of the pin 21*b* with the inner end ridge of the notch 17*c* of the rotary plate 17. However, when the lever 5 is depressed, the pull spring 19 is prevented from performing its function because the pin 21*b* on cam 21 is rotated clockwise to extend the spring 19. Correspondingly, the pull spring 25 remains in an energy stored state, when the coin-throwing actuation plate 6 is downwardly rotated. The lateral cylindrical projection 6*c* is engaged with the lateral projection 17*d* of the rotary plate 17 to prevent the forward rotation of the rotary plate 17, by the pull spring 25. This state of preventing rotation of plate 17 is maintained while the suction cup 8 is held by suction force to the attracting plate 9. Accordingly, both the pull spring 25 and the pull spring 19 are in the state of storing energy therein.

When the spring 10 overcomes the suction force of the suction cup 8 and rapidly swings the lever 5 upward, the projection 32 of the plate 6 impinges against the nail arm 23 and pushes it up to release the nail 23' from engagement with the ratchet teeth 24 and release the pull spring 19 from its stored energy state. At this moment, however, since the fy wheel 31 exerts a resistive force to the rotation of the shaft 22 of the cam plate 21 through gears 25, 27, 28 and 30, the rotation of the cam plate 21 and the reverse rotation of the pin 21*b* are retarded. Therefore, the pull spring 19 remains momentarily incapable of rotating the rotary plate 17 backward. On the other hand, since the projection 6*c* of the actuation plate 6 is released from the engagement with the projection 17*d* of the rotary plate 17, simultaneously with this releasing, the pull spring 25 is allowed to release its force and rotate the rotary plate 17, the mouth 11 is opened by contact with engaging projection 15, and the tongue piece 16 is moved forward so that its top end portion projects slightly from the opened mouth 11. Simultaneously, a coin C placed on the coin-setting part of the arm portion 5 is thrown toward the opened mouth 11 and falls on the projected tongue piece 16.

Figure 2:
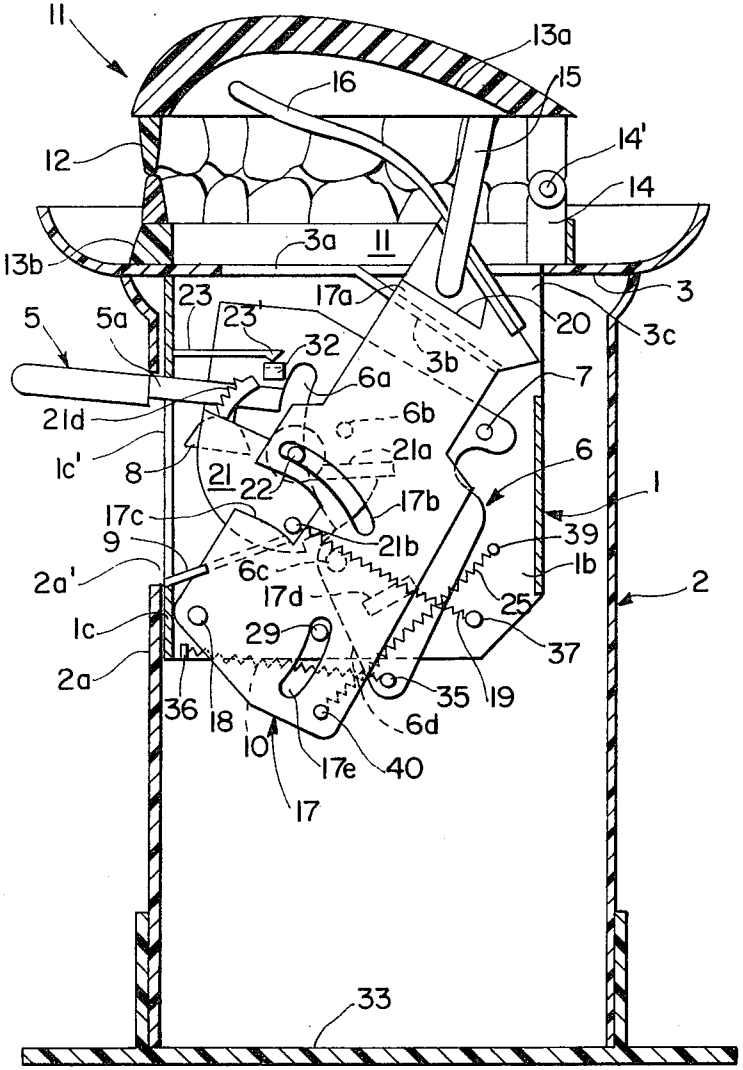
FIG. 2 is an enlarged, partially cut-out side view showing the longitudinal section of the main parts of the present invention.

Then, by the pulling force of the pull spring 19, the pin 21*b* of the cam plate 21 is drawn in a counter-clockwise direction in FIG. 2 and becomes engaged with the inner end ridge of the notch 17*c* of the plate 17 to rotate plate 17 in a clockwise direction, namely in the rearward direction. Accordingly, the tongue piece 16 is retreated and the opened mouth 11 is closed.

In the embodiment shown in the drawings, a part of the upper wall 3 of the casing 2 is notched to form a flap piece 3*b* inclined rearward obliquely through an opening 3*c* connected to the slot 3*a*. When the tongue piece 16 is returned to the original position, the coin C received on the tongue piece 16 slips down to fall into the casing 2 through said opening 3*c*. The falling coin C is received on a bottom lid 33 fitted to the lower end portion of the casing 2. Accordingly, the embodiment shown in the drawings has not only a function as a coin toy but also a function as a savings bank.

It will be apparent that many modifications and variations may be effected without departing from the scope of the novel concept of this invention. Therefore, it is intended by the appended claims to cover all such modifications and variations which fall within the true spirit and scope of the invention.

What is claimed is:

1. A coin toy, comprising:

means for throwing said coin in a predetermined direction;

means for receiving said thrown coin;

said throwing means including:

a machine frame attached to said receiving means;

a coin-throwing actuation plate rotatably mounted in a vertical position in said machine frame;

a coin-holding lever attached to the upper portion of said coin-throwing actuation plate, for holding said coin to be thrown;

a suction cup mounted on said coin-holding lever;

an attracting plate fixedly disposed on said machine frame providing a smooth face below said lever in position to receive said suction cup;

first spring means attached to said machine frame and said actuation plate to provide a force pulling said actuation plate away from said attracting plate for movement in an upward direction when said suction cup is received and held against said attracting plate by suction forces;

said receiving means having a first portion fixedly attached to said machine frame, a second portion pivotally hinged to said first portion for rotation thereabout and means responsive to upward movement of said actuation plate for pivoting said second portion into an open position and subsequently pivoting said second portion into a closed position with respect to said first portion;

wherein said coin is placed on said coin-holding lever, said coin-holding lever is manually depressed, said suction cup held against said attracting plate by said suction forces and said receiving means is in a closed position, unitl said first spring means overcomes said suction forces of said suction cup against said attracting plate, causing said coin-throwing actuation plate and said coin-holding lever to rapidly rotate in an upward direction, throwing said coin in said predetermined direction and said second portion of said receiving means pivoting open, receiving said coin and closing.

2. A coin toy as in claim 1, wherein said pivoting means comprises a rotary plate vertically mounted in said machine frame to rotate about a horizontal axis;

an elongated tongue piece having a first end attached to the upper end portion of said rotary plate and a second end of said tongue piece extending between said first and second portions;

means attached to said machine frame and abutting said rotary plate to normally bias position said rotary plate and thereby retain said tongue piece within said closed first and second portions;

a mechanism disposed to rotate said rotary plate in about said horizontal axis when said coin-throwing actuation plate and said coin-holding lever of said throwing means are rapidly rotated upward by the force of said first spring means;

wherein said tongue piece is moved when said first and second portions are relatively open so that said second end of said tongue piece projects slightly to receive said thrown coin, and said tongue piece is returned to its said normal position by the action of said biasing means.

3. A coin toy as set forth in claim 1, wherein said receiving means is a replica of a mouth, said first portion is a replica of the lower jaw of said mouth and said second portion is a replica of the upper jaw of said mouth.

4. A coin toy as set forth in claim 2, wherein said pivoting means is mechanically interlocked with said actuation plate for effecting said opening and mechanically interlocked to said rotary plate for subsequently effecting said closing.

5. A coin toy for throwing a coin by a coin-holding lever toward the inside of a replica of a mouth, comprising:

a machine frame attached below said mouth;

a coin-throwing actuation plate vertically mounted for rotation about a first horizontal axis in said machine frame, having said coin-holding lever attached to the upper portion thereof and extending outwardly of said machine frame;

a suction cup mounted to the underside of the coin-holding lever within said machine frame;

an attracting plate fixedly disposed below said suction cup on said machine frame;

first spring means attached to said machine frame and said actuation plate to provide a pulling force when said suction cup is held against said attracting plate by suction forces;

an actuation lever on said mouth engaging said actuation plate for opening said mouth;

a rotary plate vertically mounted in said machine frame to rotate about a second horizontal axis;

an elongated tongue piece having a first end attached to the upper end portion of said rotary plate and the second end of said tongue piece extending into said mouth;

means attached to the machine frame and abutting said rotary plate to normally bias position said rotary plate and thereby retain said tongue piece within said mouth;

a mechanism disposed to rotate said rotary plate about said second horizontal axis when said coin-throwing actuation plate, with said coin-holding lever, is rapidly rotated by the force of said first spring means;

wherein a coin is placed on said coin-holding lever, said coin-holding lever is depressed, said suction cup is attracted to said attracting plate and said mouth remains closed, until said first spring means overcomes the suction forces of said suction cup against said attracting plate causing said coin throwing actuation plate and said coin-holding lever to rotate about said first horizontal axis in an upward direction, opening said mouth by the movement of said actuation lever and throwing said coin into said mouth; and wherein said tongue piece in said mouth is moved with the opening of said mouth by the movement of said actuation lever so that said second end of said tongue piece projects slightly from said opened mouth to receive said coin thrown into said opened mouth, said tongue piece is returned inside said opened mouth by the action of said biasing means and said opened mouth is thereby closed.

* * * * *